United States Patent [19]

Zink et al.

[11] Patent Number: 4,497,986

[45] Date of Patent: Feb. 5, 1985

[54] LINE SWITCH ASSEMBLY FOR A TIMING MECHANISM

[75] Inventors: David E. Zink, Indianapolis; Garry A. Stout, Bargersville, both of Ind.

[73] Assignee: Emhart Industries, Inc., Indianapolis, Ind.

[21] Appl. No.: 533,114

[22] Filed: Sep. 19, 1983

[51] Int. Cl.[3] ..... H01H 43/10

[52] U.S. Cl. ..... 200/38 R; 200/38 A

[58] Field of Search ..... 200/38 R, 38 A, 38 B, 200/37 A

[56] References Cited

U.S. PATENT DOCUMENTS 3,704,351 11/1972 Linn et al. ..... 200/38 R 3,811,019 5/1974 Solari ..... 200/37 A X 4,146,760 3/1979 Voland ..... 200/38 A

FOREIGN PATENT DOCUMENTS 1046324 10/1966 United Kingdom ..... 200/38

*Primary Examiner*—A. D. Pellinen

*Assistant Examiner*—Susan Steward

*Attorney, Agent, or Firm*—Robert F. Meyer

[57] ABSTRACT

A timing mechanism has a rotating camstack which opens and closes electrical contacts that are carried by electrical contact blades which are actuated by the camstack. One of the two cooperating electrical contact blades is also actuated by a first sliding member that is manually operated by an actuator to open and close a circuit to a main power supply. Manual rotation of the camstack to set a program is prevented when the circuit to the main power supply is closed by a second sliding member that is simultaneously operated off the same actuator. A step in a cam associated with the electrical contact blade to the main power supply opens the circuit to the main power supply when there is a malfunction.

2 Claims, 6 Drawing Figures

FIG.1
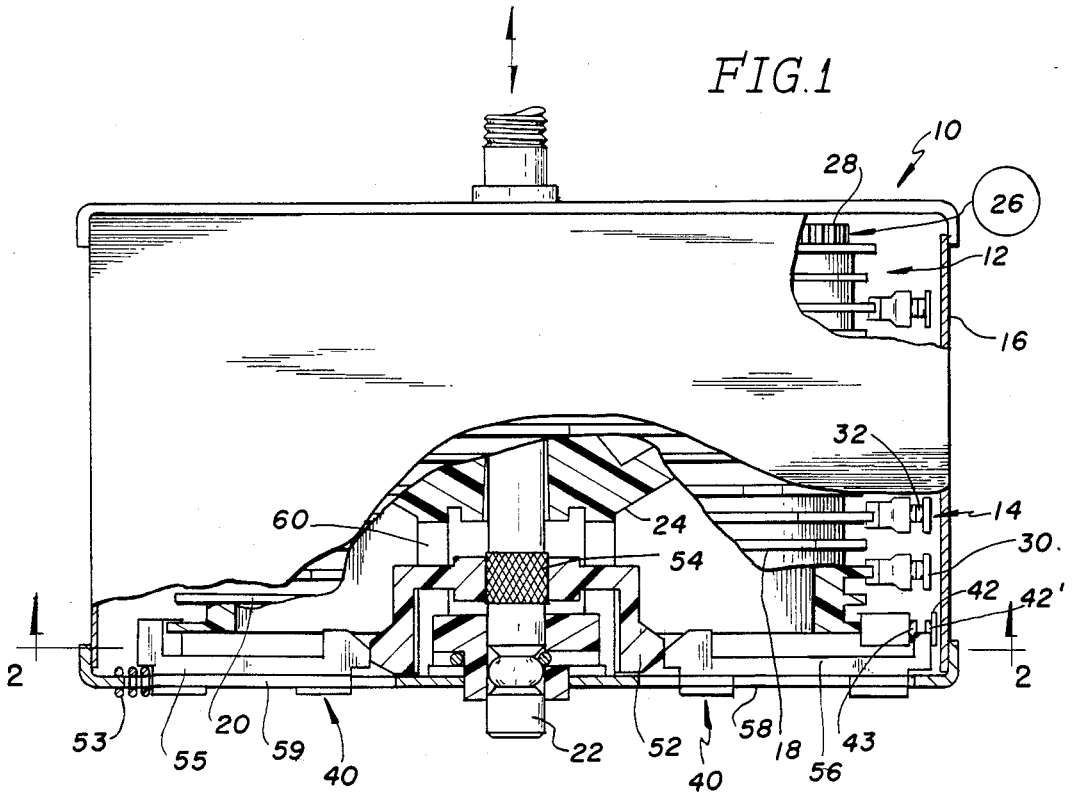
FIG.2A
FIG.3A
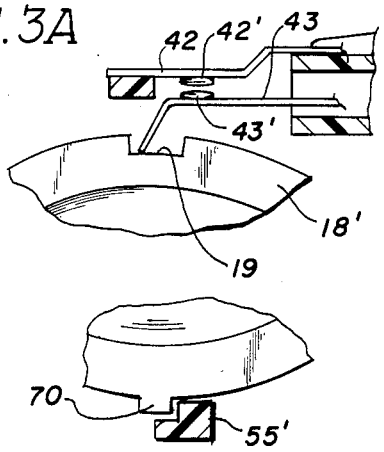
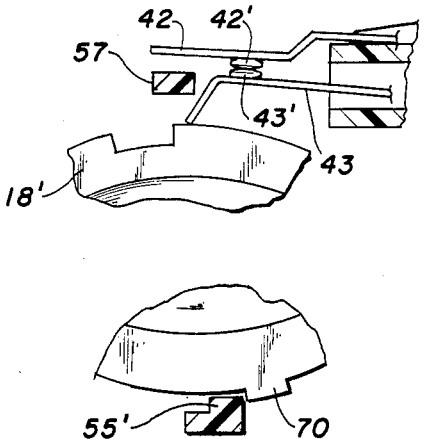
FIG.3B
FIG.2B

LINE SWITCH ASSEMBLY FOR A TIMING MECHANISM

BACKGROUND OF THE INVENTION

Generally speaking, the present invention pertains to a timing mechanism which comprises a program cam and switch assembly selectively opening and closing electrical circuits to provide variable programs, power drive means applying power driven rotation to the cam assembly, and an electrical power line switch switch assembly comprising a first movable electrical contact blade engaging a cam means, a cooperating second movable electrical contact blade having a distal end carried by a first slider, a stop means carried by the cam means, a second slider engaging the stop means, and manual actuator means engaging the first and second sliders to actuate them simultaneously.

The present invention is directed to a timing mechanism, and more particularly, to a timing mechanism utilizing a line switch.

Timing mechanisms have been used for many years to control the operation of an appliance such as a washer, dryer and dishwasher. In most, if not all, of such applications a line switch is usually used to provide a manual means of shutting off all electrical power to the timing mechanism especially during those times when the appliance operator manually rotates the timing mechanism's camstack to set a program. In accordance with the present invention, a line switch assembly is provided which provides for a means to prevent manual rotation of the camstack when the line switch is closed.

OBJECTS OR FEATURES OF THE INVENTION

It is, therefore, a feature of the present invention to provide a timing mechanism with a power line switch switch assembly having a means to prevent manual camstack rotation when a line switch is closed. Another feature of the invention is to provide a power line switch including a line switch electrical contact blade adapted to be electrically connected to a main power supply, a manually operable actuator means operating the power line switch, and a stop means operable off the manually operable actuator means preventing a setting of a camstack when the power line switch is closed.

These and other features of the invention will be apparent from the following description taken in conjunction with the accompanying drawings.

BRIEF DESCRIPTION OF THE DRAWINGS

FIG. 1 is a section taken in elevation of a timing mechanism employing the features of the invention.

FIGS. 2A, 2B and 3A, 3B are views taken along the line 2—2 of FIG. 1 showing a different operating mode of the line switch assembly of the timing mechanism.

DETAILED DESCRIPTION OF THE INVENTION

Figure 4:
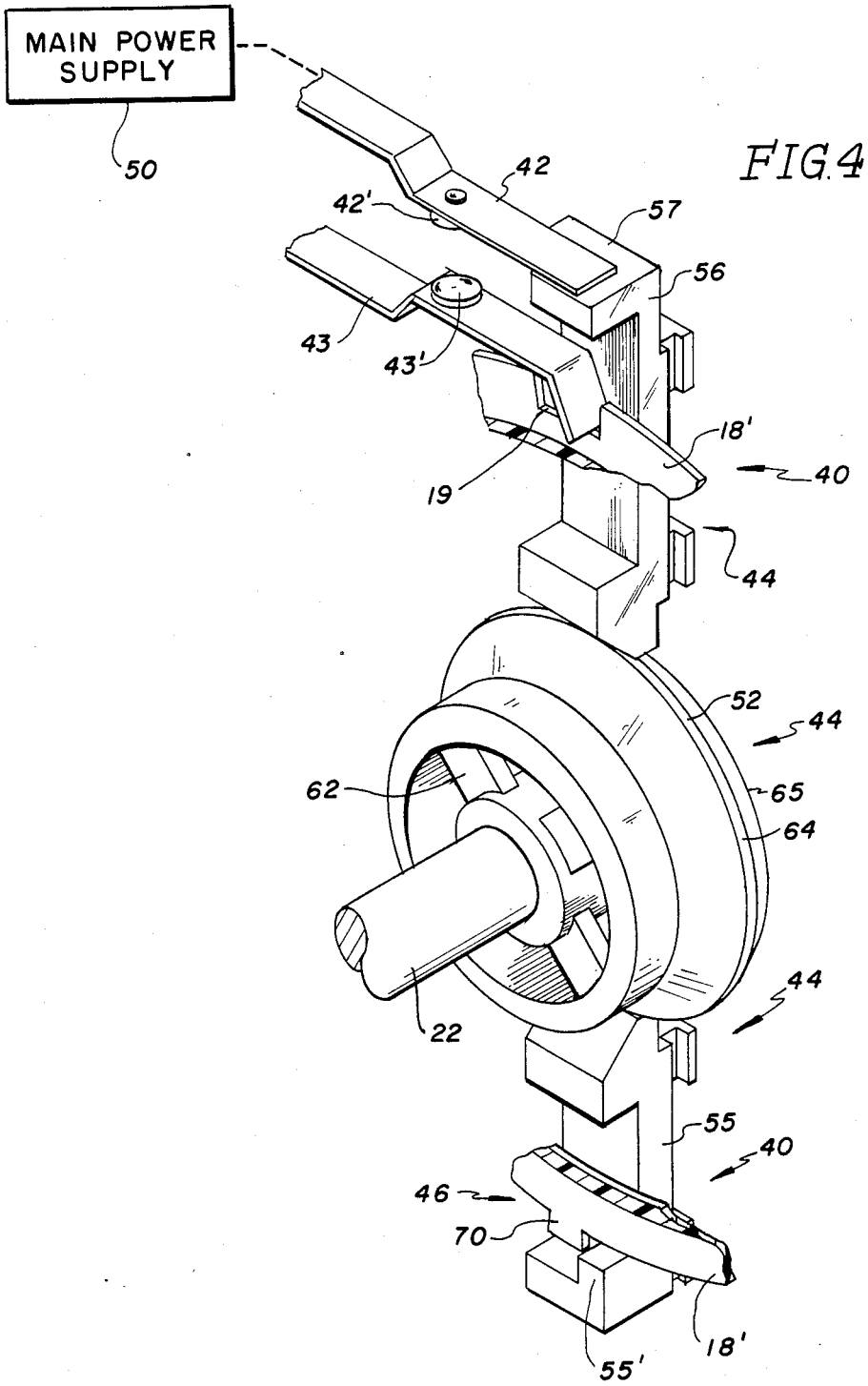
FIG. 4 is an exploded view showing the combination line switch assembly.

Referring now to FIGS. 1-3B, there is shown a timing mechanism 10 employing the features of the invention. The timing mechanism, in general, includes a cam assembly 12 and switch assembly 14 which are carried in a housing 16. Cam assembly 12 includes a camstack 18 having a plurality of individual cams 20 thereon and which is rotatably carried on a shaft 22 through a hub portion 24. The camstack is rotated through a power drive means 26, such as a synchronous motor, the motor being coupled to a gear 28 which is part of the camstack. Shaft 22 is manually axially indexable and manually rotatable.

Switch assembly 14 includes a plurality of electrical contact spring blades 30 which engage or are otherwise biased by the cams 20 of the cam assembly to open and close electrical contacts 32 associated with each blade to complete electrical circuits and thus provide variable programs for an appliance.

In accordance with the present invention, there is provided an electrical power line switch assembly 40 which provides for manual removal of electrical power from the timing mechanism as well as provide a means to prevent manual rotation of camstack 18 when the power line switch is closed.

Referring to FIG. 4, electrical power line switch assembly 40 includes power line switch movable electrical contact blades 42 and 43, actuator means 44, and stop means 46 preventing manual rotation of camstack 18 when the power line switch is closed. Line switch electrical contact blade 42 is electrically connected to a main power supply 50 such as an electrical outlet of a building where an appliance is situated. As shown in FIGS. 2, 3, and 4, each blade includes mating electrical contacts 42' and 43'.

Referring to FIGS. 1 and 4, actuator means 44 includes a hub 52, which is carried on shaft 22 through knurl 54, and sliders 56 and 55 which engage the hub and slide in slots 58 and 59, respectively. Slider 56 is spring biased through blade 42 while slider 55 is spring biased through coil spring 53 which is biased between the slider and the housing 16. Slider 56 includes a shelf 57 which engages blade 42 at its distal end. Hub 52 rotates with hub portion 24 of camstack 18 through a plurality of tongues 60 extending from the hub portion 24 and engaging web 62 carried in hub 52. Hub 52 includes a rim 64 having a tapered side 65 against which the sliders are biased.

Stop means 46 includes slider 55 which engages a step or cam lobe 70 of cam 18' when step 55' of the slider is manually set in an interference path with the cam lobe.

The operation of the timing mechanism can now be described. With reference to FIGS. 1 and 4, shaft 22 has been indexed in causing slider 56 to ramp up tapered side 65 to rim 64 to engage electrical contact blade 42 so as to open electrical contacts 42' and 43' and to open the circuit to the main power supply 50 to shut off the power to the timing mechanism. Slider 55 has also been ramped to rim 64 to remove step 55' from an interference path with cam lobe 70. Camstack 18 can now be manually rotated to set the program for the appliance.

Referring to FIGS. 2A, 2B and 4, shaft 22 is indexed out to permit slider 56 to ramp down side 65 so as to permit blade 42 to drop and close contacts 42' and 43' and thus close an electrical circuit to the main power supply. Slider 55 is likewise ramped down side 65 to place step 55' in an interference path with lobe 70, the lobe, however, having been rotated past the step. Camstack 18 is now rotated by power drive means 26 until the program of the timing mechanism has been completed at which time one of the electrical contacts 32 are opened to shut off power to the timer motor 28. Camstack 18 cannot be manually set until shaft 22 is indexed in to remove step 55' from the interference path with lobe 70.

There is also provided, in the present timing mechanism, a safety feature that prevents camstack 18 from continuing to rotate past its program stop point when there is an appliance malfunction. Referring to FIGS. 3A and 3B, such safety feature is provided by a step 19 in cam 18' which is located or synchronized with the program of the camstack as to be operative during the "off" time of the program. That is, when power to the timer motor 28 is supposed to be shut off. Thus, when the timer motor keeps running camstack 18 continues to rotate until blade 43 reaches step 19 to drop and open contacts 42' and 43' to open the circuit to the main power supply. Cam lobe 70 will also be adjacent to step 55' of slider 55 to prevent manual rotation of the camstack.

What is claimed is:

1. A timing mechanism comprising a program cam and switch assembly selectively opening and closing electrical circuits to provide variable circuits, power drive means applying power driven rotation to said cam assembly and an electrical power line switch assembly comprising:

(a) a first movable electrical contact blade engaging a cam, (b) a cooperating second movable electrical contact blade having a distal end carried by a first slider, (c) electrical contacts carried by said first and second movable electrical contact blades, (d) a stop means carried by said cam, (e) a second slider engaging said stop means, and (f) manual actuator means engaging said first and second sliders to actuate same simultaneously.

2. A timing mechanism according to claim 1 further including a step in said cam receiving said first movable electrical contact blade.

* * * * *